US012680774B2

(12) United States Patent
Alexander et al.

(10) Patent No.: US 12,680,774 B2
(45) Date of Patent: Jul. 14, 2026

(54) SAFING SECTOR AND METHOD OF USE

(71) Applicant: TMP WEAPONS, LLC, Reno, NV (US)

(72) Inventors: Joshua Phillip Alexander, Scottsdale, AZ (US); Stephen Mckinnley Estep, New River, AZ (US)

(73) Assignee: TMP WEAPONS, LLC, NV (US)

( * ) Notice: Subject to any disclaimer, the term of this patent is extended or adjusted under 35 U.S.C. 154(b) by 203 days.

(21) Appl. No.: 18/531,390

(22) Filed: Dec. 6, 2023

(65) Prior Publication Data

US 2025/0189249 A1 Jun. 12, 2025

(51) Int. Cl.

| | |
|---|---|
| ***F41A 9/36*** | (2006.01) |
| ***F41A 17/56*** | (2006.01) |
| ***F41A 17/64*** | (2006.01) |
| ***F41F 1/10*** | (2006.01) |

(52) U.S. Cl.

CPC ..... *F41A 17/56* (2013.01); *F41A 9/36* (2013.01); *F41A 17/64* (2013.01); *F41F 1/10* (2013.01)

(58) Field of Classification Search

CPC .. F41A 9/36; F41A 17/56; F41A 17/64; F41F 1/10

See application file for complete search history.

(56) References Cited

U.S. PATENT DOCUMENTS

| | | | | |
|---|---|---|---|---|
| 3,380,341 | A * | 4/1968 | Chiabrandy | F41F 1/10 89/12 |
| 3,766,821 | A * | 10/1973 | Cozzy | F41F 1/10 89/149 |
| 7,013,789 | B2 * | 3/2006 | Dillon | F41F 1/10 89/12 |
| 7,703,374 | B1 * | 4/2010 | Dillon | F41A 17/32 89/12 |
| 10,816,294 | B2 * | 10/2020 | Todd, II | F41F 1/10 |
| 11,441,864 | B1 * | 9/2022 | Garwood | F41A 35/00 |
| 12,281,874 | B2 * | 4/2025 | Paulson | F41F 1/10 |
| 2005/0115393 | A1 * | 6/2005 | Dillon | F41A 17/00 89/12 |
| 2010/0116124 | A1 * | 5/2010 | Dillon | F41A 17/32 89/12 |
| 2020/0263945 | A1 * | 8/2020 | Todd, II | F41A 17/32 |
| 2021/0116206 | A1 * | 4/2021 | Schira | F41A 19/18 |
| 2025/0189249 | A1 * | 6/2025 | Alexander | F41A 17/00 |

* cited by examiner

*Primary Examiner* — Gabriel J. Klein
(74) *Attorney, Agent, or Firm* — PROCOPIO, CORY, HARGREAVES & SAVITCH LLP

(57) ABSTRACT

A safing sector for a minigun including a housing with an opening adjacent to barrels of the minigun comprising a safing sector cover; one or more retaining pin assemblies configured to retain the cover to the housing over the opening; a safing sector slide member; a safing sector slide control mechanism including a locking arm configured to impart forward and rearward sliding movement of the safing sector slide member relative to the safing sector cover between at least a fire position and a safe position, and a locking mechanism pivotally coupled to the locking arm and including a shelf stop to engage a locking shelf of the safing sector cover to lock the locking arm and the safing sector slide member in the fire position.

10 Claims, 10 Drawing Sheets

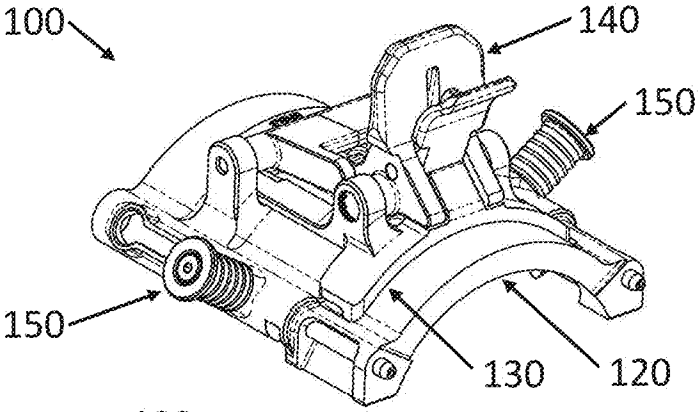
FIG. 1A
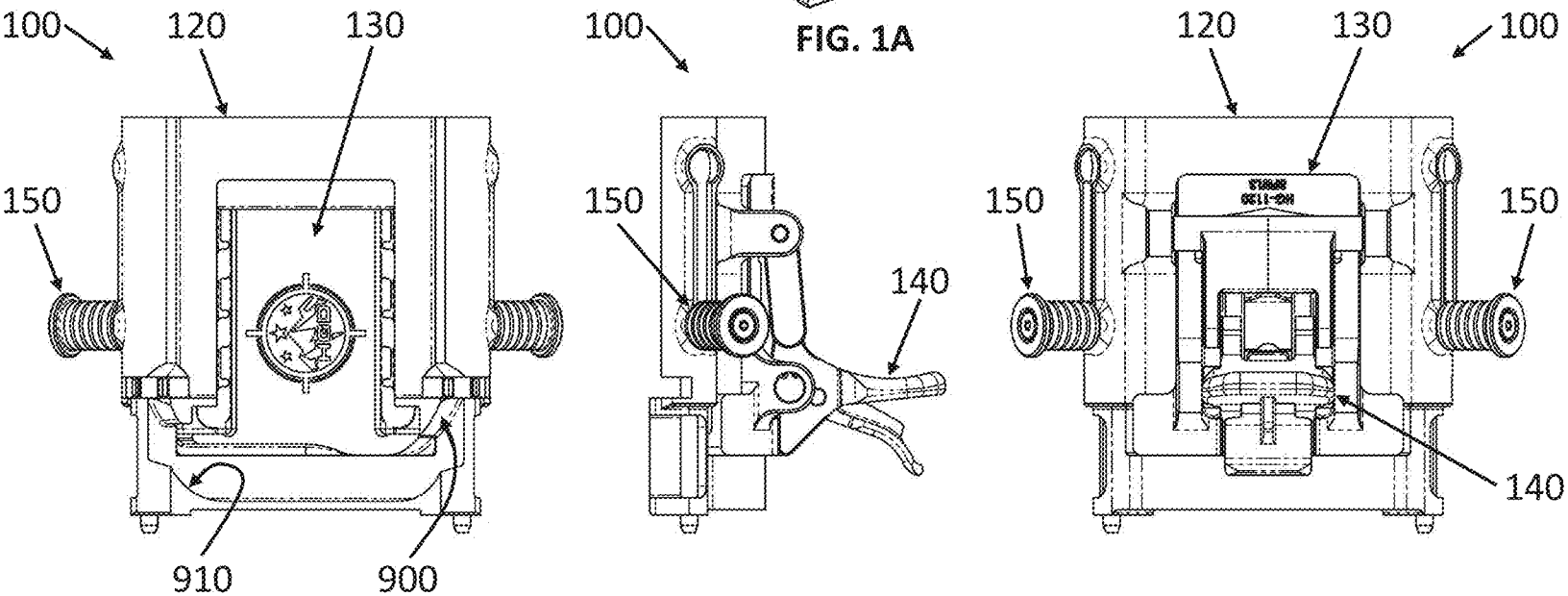
FIG. 1B
FIG. 1C
FIG. 1D

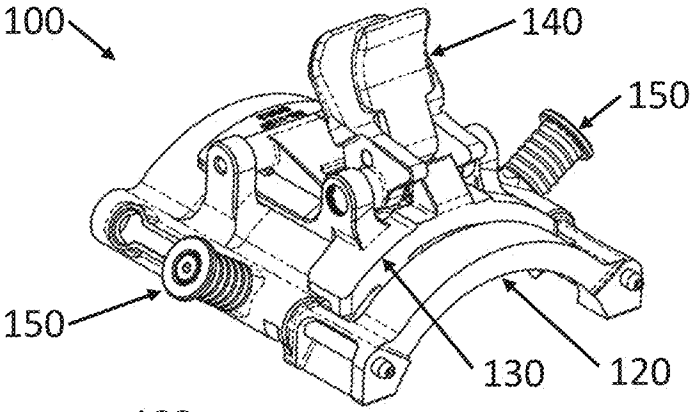
FIG. 2A
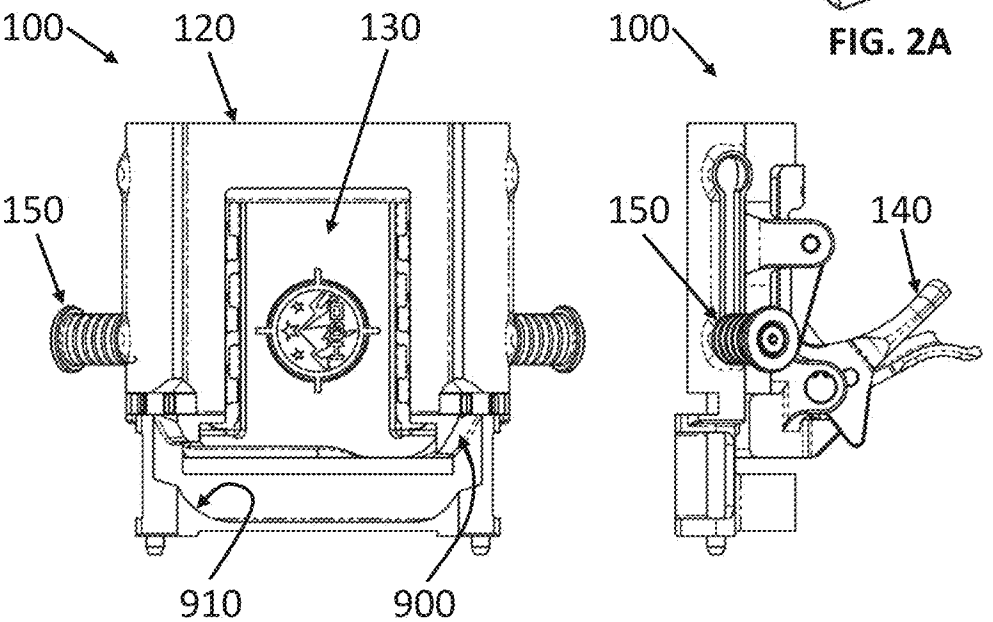
FIG. 2B
FIG. 2C
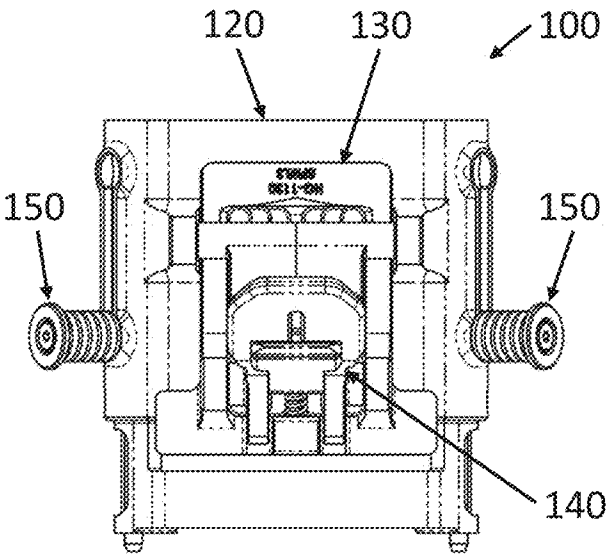
FIG. 2D

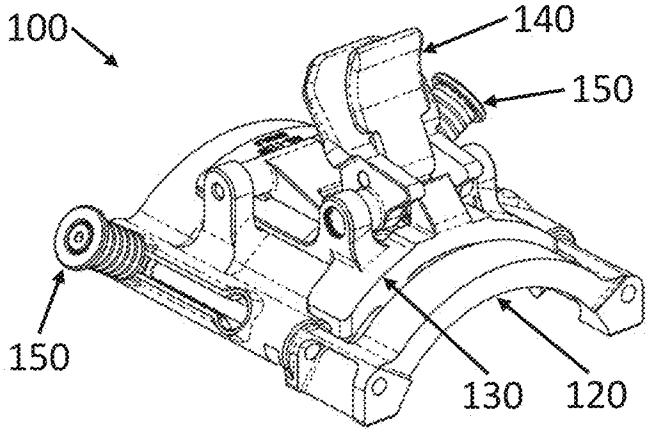
FIG. 3A
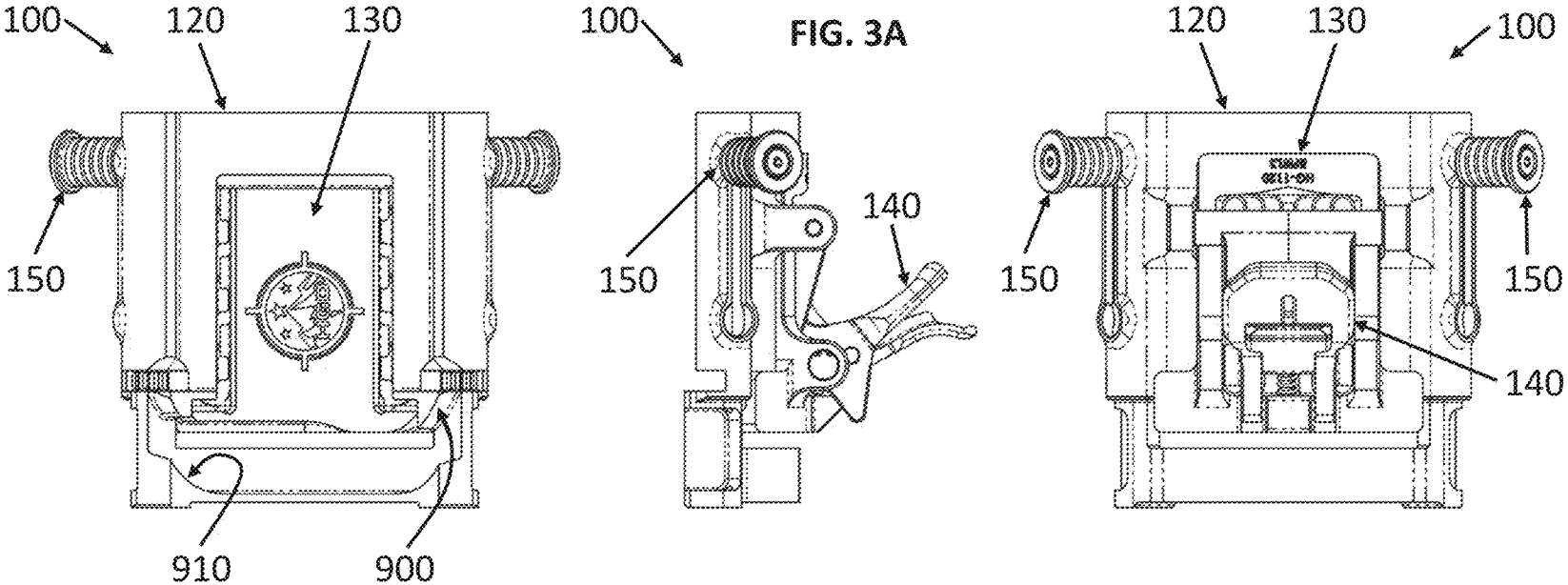
FIG. 3D
FIG. 3C
FIG. 3B

SAFING SECTOR AND METHOD OF USE

FIELD OF THE INVENTION

The present invention relates to safing sectors for firearms.

SUMMARY OF THE INVENTION

An aspect of the invention involves a safing sector that easily and quickly renders a M134 minigun (or similar machine guns) guns safe or fire without having to remove components from the assembly. The one inseparable assembly of the safing sector compared to the six removable components of the prior safing sector that could be lost, rendering the minigun non-functional, prevents essential components from being lost. By not removing components and simply sliding the searing surface back, the minigun allows rotation without striking the primer while also preventing a jam in the minigun.

Another aspect of the invention involves a safing sector for a minigun including a housing with an opening adjacent to barrels of the minigun comprising a safing sector cover configured to cover the opening of the housing of the minigun and including a locking shelf; one or more retaining pin assemblies configured to retain the cover to the housing of the minigun; a safing sector slide member configured to slide forward and rearward relative to the safing sector cover; and a safing sector slide control mechanism configured to impart the forward and rearward sliding movement of the safing sector slide member relative to the safing sector cover between at least a fire position and a safe position, where the barrels of the minigun may be rotated electrically without firing and without bolt assemblies becoming damaged, the safing sector slide control mechanism includes a locking arm configured to impart forward and rearward sliding movement of the safing sector slide member relative to the safing sector cover, and a locking mechanism pivotally coupled to the locking arm and including a locking mechanism shelf stop to engage the locking shelf of the safing sector cover to lock the locking arm and the safing sector slide member in the fire position.

One or more implementations of the aspect of the invention described immediately above includes one or more of the following: the locking arm includes a pivoting base, and the locking mechanism includes a base pivotally coupled to the pivoting base of the locking arm between a locking position where the locking mechanism shelf stop engages the locking shelf of the safing sector cover to lock the locking arm and the safing sector slide member in the fire position and an unlocked position where locking arm is free to pivot to impart forward and rearward sliding movement of the safing sector slide member relative to the safing sector cover; the movable arm is configured to impart rearward and forward sliding movement of the safing sector slide member relative to the safing sector cover between at least three positions, a fire position, a safe position, and an install/uninstall position; the locking mechanism includes a spring to urge the locking mechanism shelf stop towards the locking shelf of the safing sector cover; and/or the one or more retaining pin assemblies include a locating knob actuatable to latch and unlatch the one or more retaining pin assemblies relative to the safing sector cover.

Another aspect of the invention involves a method of using a safing sector for a minigun including a housing with an opening adjacent to barrels of the minigun, the safing sector comprising a safing sector cover configured to cover the opening of the housing of the minigun and including a locking shelf; one or more retaining pin assemblies configured to retain the cover to the housing of the minigun; a safing sector slide member configured to slide forward and rearward relative to the safing sector cover; and a safing sector slide control mechanism configured to impart the forward and rearward sliding movement of the safing sector slide member relative to the safing sector cover between at least a fire position and a safe position, where the barrels of the minigun may be rotated electrically without firing and without bolt assemblies becoming damaged, the safing sector slide control mechanism includes a locking arm configured to impart forward and rearward sliding movement of the safing sector slide member relative to the safing sector cover, and a locking mechanism pivotally coupled to the locking arm and including a locking mechanism shelf stop to engage the locking shelf of the safing sector cover to lock the locking arm and the safing sector slide member in the fire position, the method comprising imparting forward and rearward sliding movement of the safing sector slide member relative to the safing sector cover by moving the locking arm; and locking the locking arm and the safing sector slide member in the fire position by engaging the locking mechanism shelf stop with the locking shelf of the safing sector cover.

One or more implementations of the aspect of the invention described immediately above includes one or more of the following: the locking arm includes a pivoting base, and the locking mechanism includes a base pivotally coupled to the pivoting base of the locking arm between a locking position where the locking mechanism shelf stop engages the locking shelf of the safing sector cover to lock the locking arm and the safing sector slide member in the fire position and an unlocked position where locking arm is free to pivot to impart forward and rearward sliding movement of the safing sector slide member relative to the safing sector cover, and locking the locking arm and the safing sector slide member in the fire position by pivoting the base of the locking mechanism relative to the pivoting base of the locking arm to the locking position where the locking mechanism shelf stop engages the locking shelf of the safing sector cover; the movable arm is configured to impart rearward and forward sliding movement of the safing sector slide member relative to the safing sector cover between at least three positions: a fire position, a safe position, and an install/uninstall position, and method further comprising imparting rearward and forward sliding movement of the safing sector slide member relative to the safing sector cover between at least three positions, a fire position, a safe position, and an install/uninstall position, by moving the locking arm; the locking mechanism includes a spring to urge the locking mechanism shelf stop towards the locking shelf of the safing sector cover, and locking includes urging the locking mechanism shelf stop towards the locking shelf of the safing sector cover with the spring; and/or the one or more retaining pin assemblies include a locating knob actuatable to latch and unlatch the one or more retaining pin assemblies relative to the safing sector cover, and the method further comprising actuating the locating knob actuatable to latch and unlatch the one or more retaining pin assemblies relative to the safing sector cover.

BRIEF DESCRIPTION OF DRAWINGS

The accompanying drawings, which are incorporated in and form a part of this specification illustrate embodiments of the invention and together with the description, serve to explain the principles of the invention.

FIGS. 1A, 1B, 1C, 1D are perspective, bottom plan, side elevational, and top plan views of an embodiment of a safing sector shown in a closed or fire position.

FIGS. 2A, 2B, 2C, 2D are perspective, bottom plan, side elevational, and top plan views of the safing sector of FIGS. 1A-1D shown in a safe or fully open position.

FIGS. 3A, 3B, 3C, 3D are perspective, bottom plan, side elevational, and top plan views of the safing sector of FIGS. 1A-1D shown in an uninstalled, safe, or fully open position.

DESCRIPTION OF EMBODIMENT OF THE INVENTION

Figure 4:
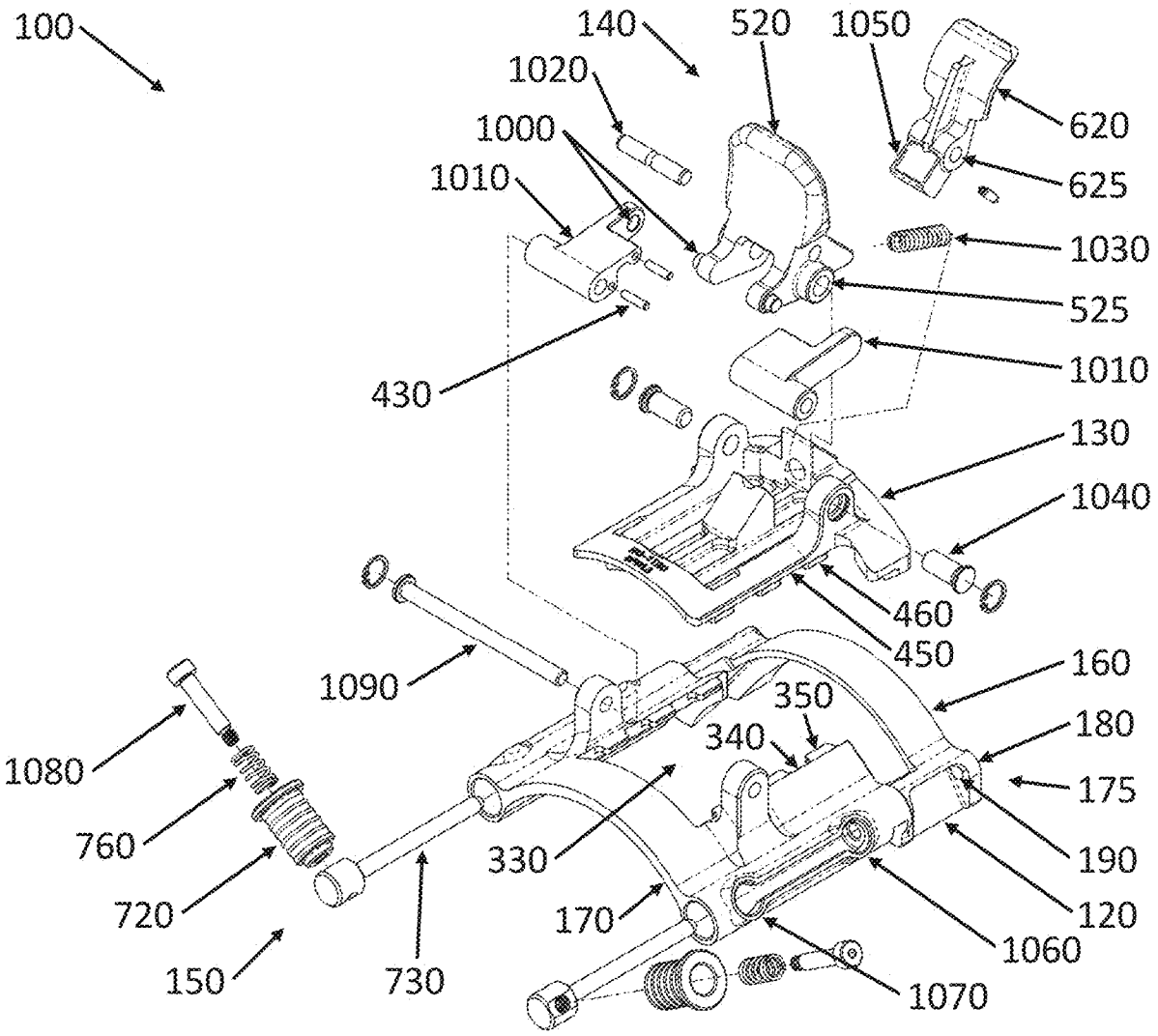
FIG. 4 is an exploded perspective view of the safing sector of FIGS. 1A-1D.
Figure 5:
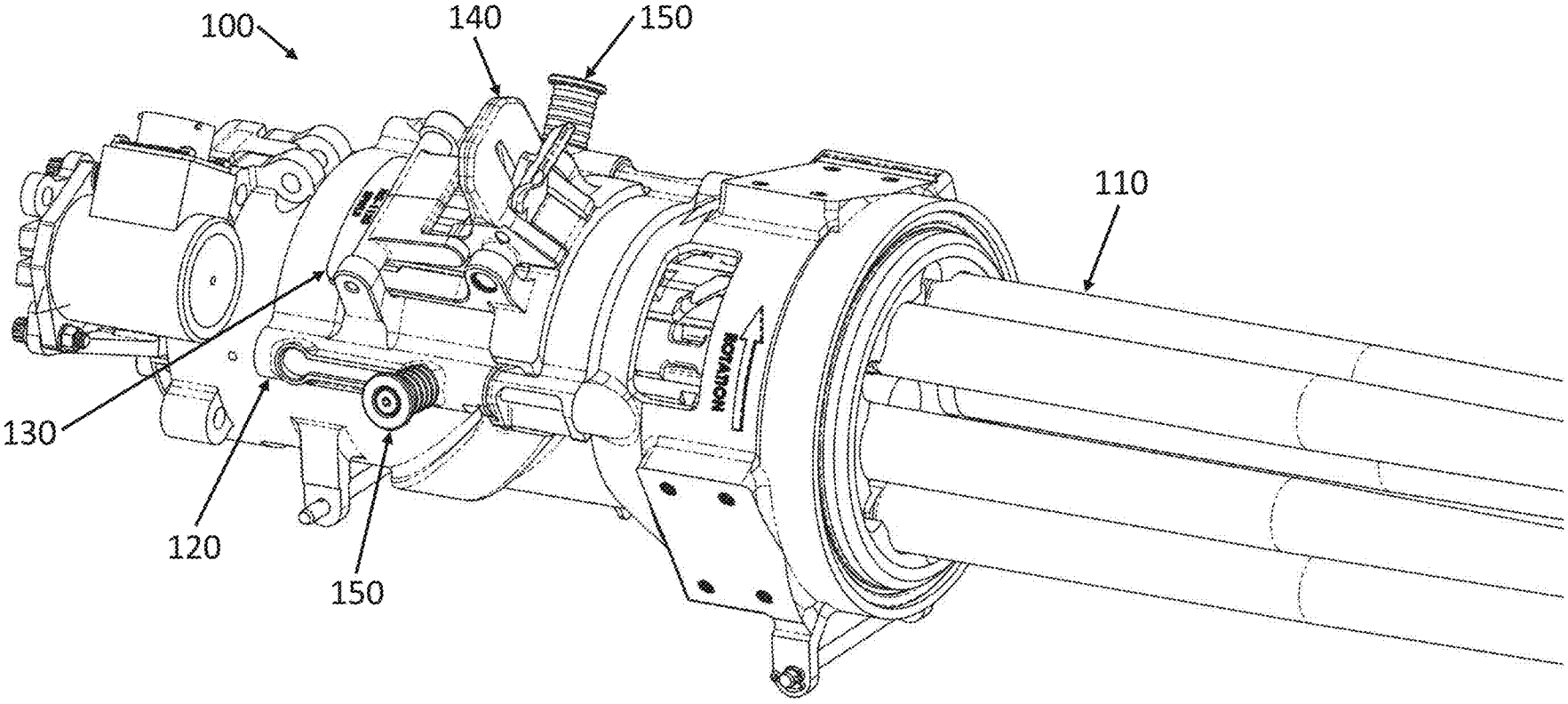
FIG. 5 is a perspective view of a M134 Minigun with the safing sector of FIGS. 1A-1D installed and shown in the closed or fire position.
Figure 6:
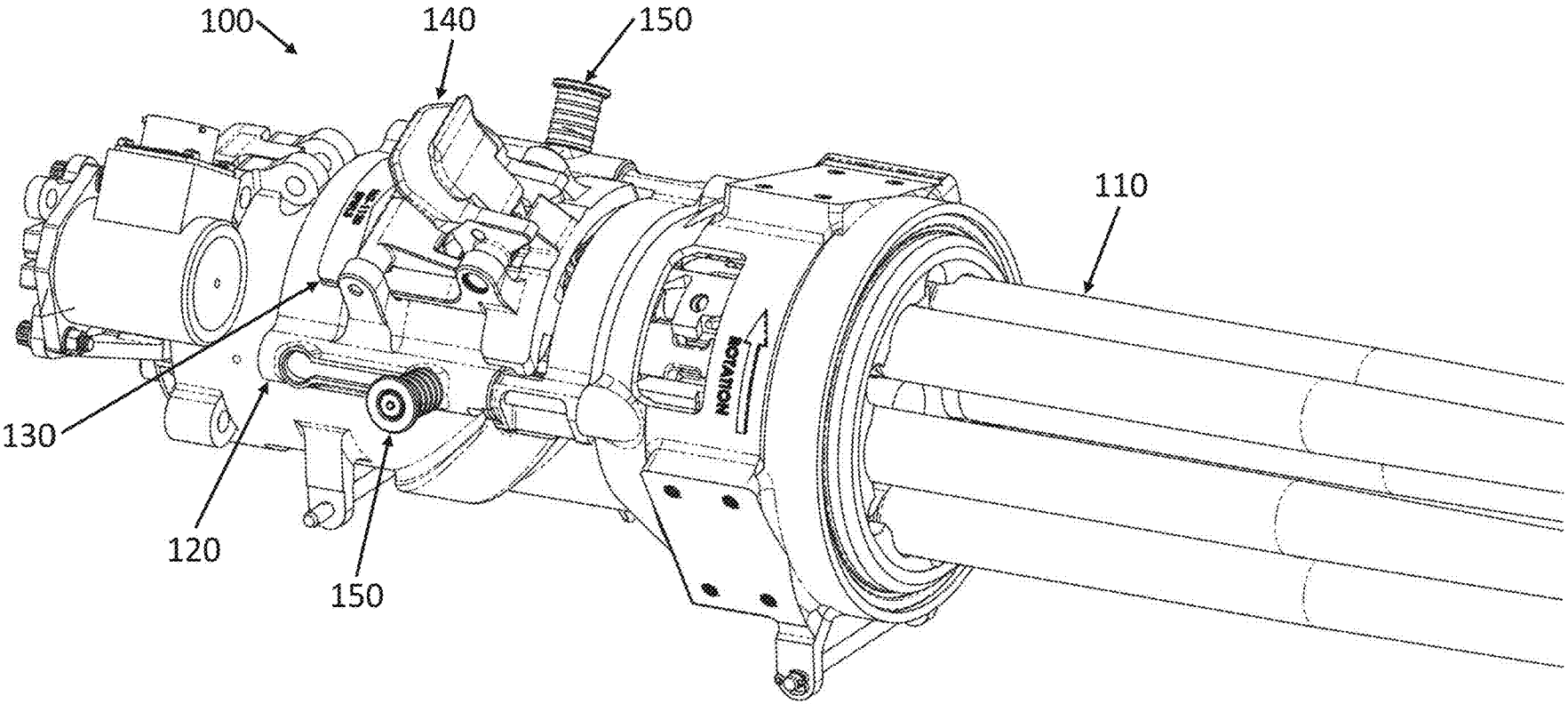
FIG. 6 is a perspective view of the M134 Minigun with the safing sector installed, similar to FIG. 5, but with the safing sector shown in the safe or fully open position.
Figure 7:
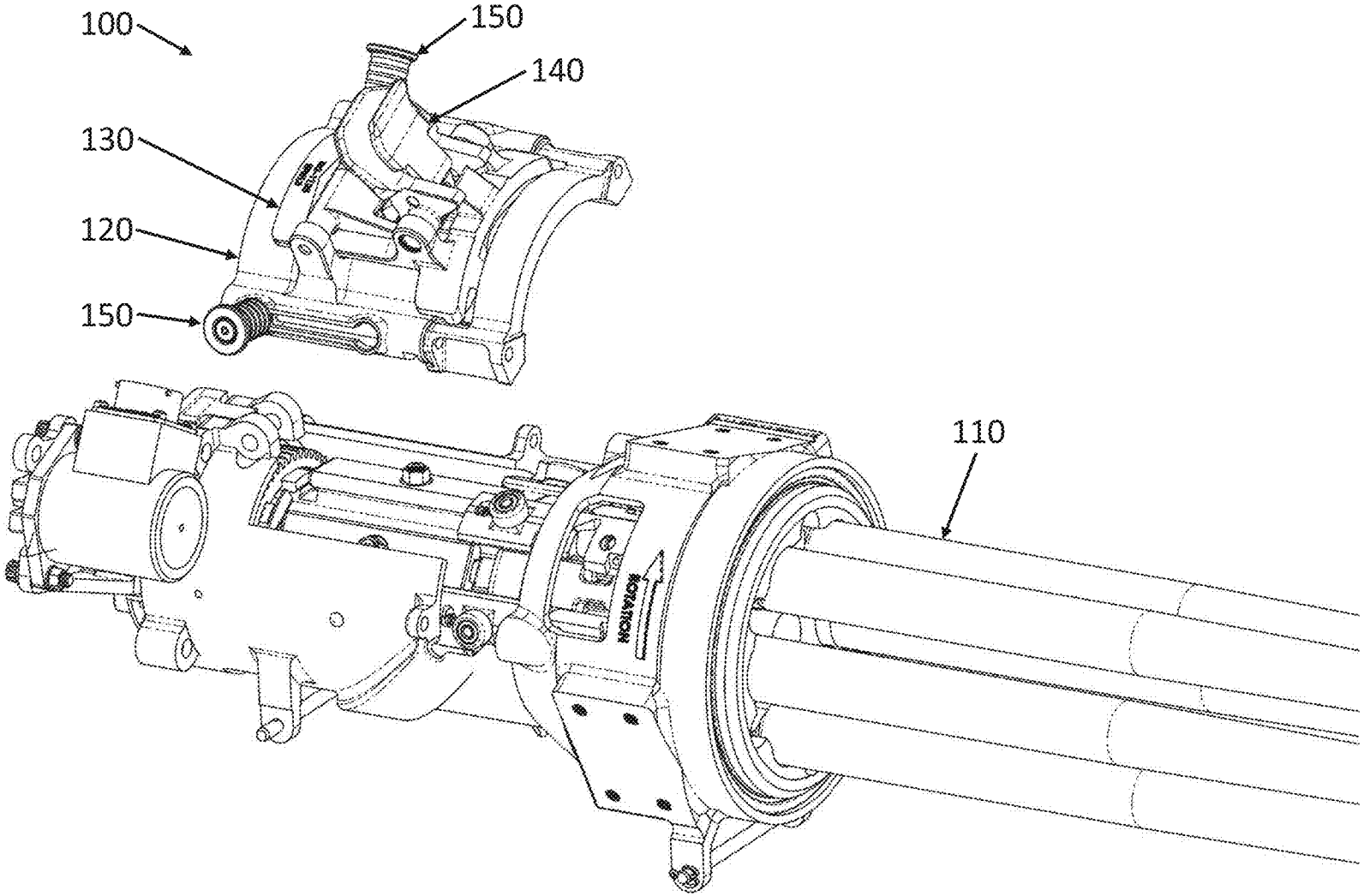
FIG. 7 is a perspective view of the M134 Minigun with the safing sector shown removed.
Figure 8:
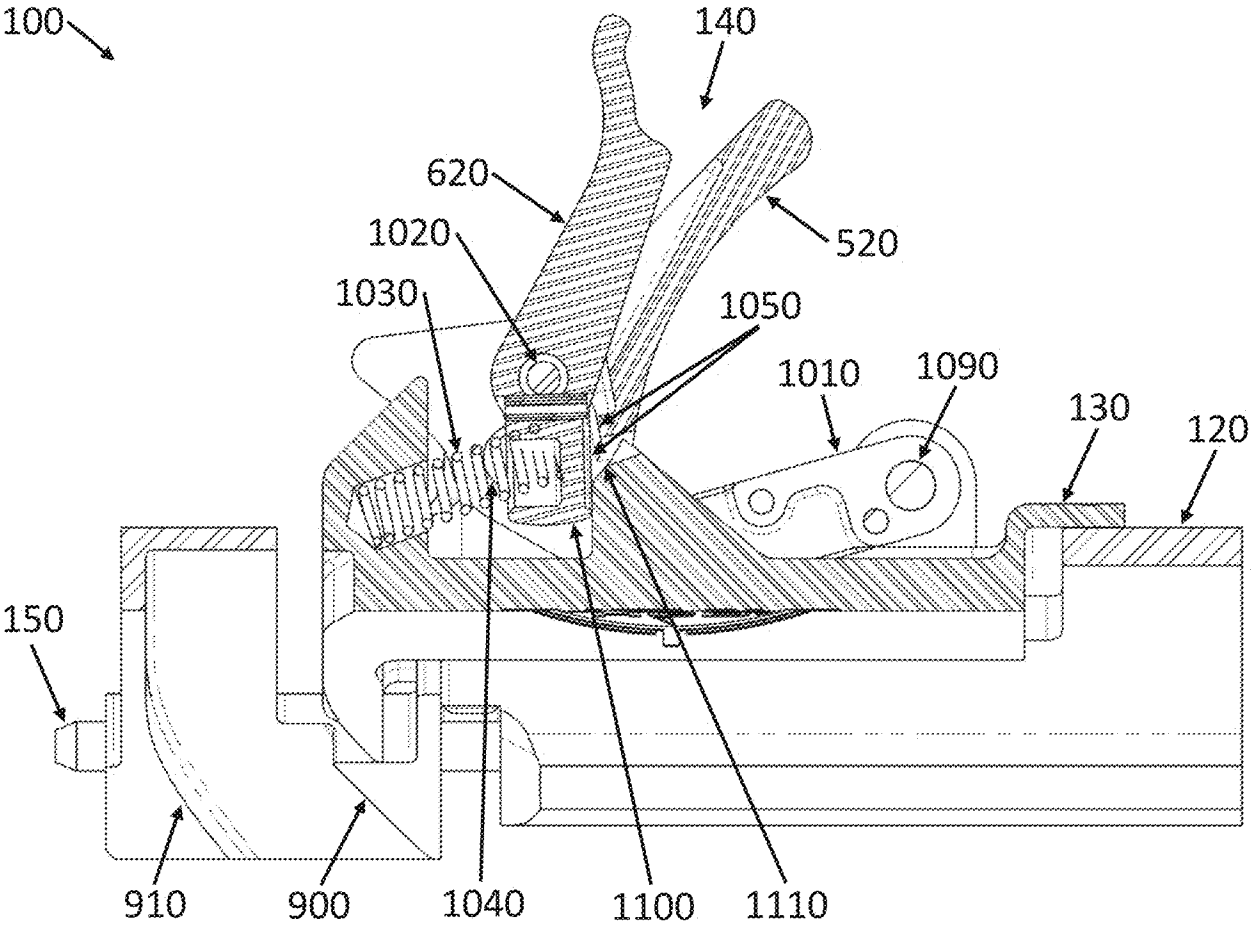
FIG. 8 is a cross-sectional view of the M134 Minigun with the safing sector shown in the safe or fully open.

With reference to FIGS. 1A-10, an embodiment of a safing sector 100 for a M134 minigun 110 or similar machine gun and method of using the same will be described. The safing sector 100 easily and quickly renders the M134 minigun safe or fire without having to remove components from the assembly. The one inseparable assembly of the safing sector 100 compared to the six removable components of the prior safing sector that could be lost, rendering the minigun non-functional, prevents essential components from being lost. By not removing components and simply sliding the searing surface back, the minigun allows rotation without striking the primer while also preventing a jam in the minigun.

The safing sector 100 includes a safing sector cover 120, a safing sector slide member 130, a safing sector slide control mechanism 140, and one or more (e.g., a pair of) retaining pin assemblies 150.

The safing sector cover 120 includes a first curved section 160 and a second curved section 170.

The first curved section 160 terminates in opposite retaining pin receiving ends 175 with pin receiving flanges 180 and pin receiving holes 190 therein. The second curved section 170 includes a generally rectangular opening 330 with inner lateral edges 340 including a plurality in inwardly extending guide members 350.

The safing sector slide member 130 include a generally rectangular undersection 450. A plurality of outwardly extending guide members 460 extend from outer lateral edges of the undersection 450. The safing sector slide control mechanism 140 includes a locking arm 520 including a pivoting base 525, a locking mechanism 620 including a pivoting base 625, a locking arm pivot 1000, a safing sector slide linkage 1010, a locking mechanism pivot pin 1020 that couples the pivoting base 625 of the locking mechanism 620 to the pivoting base 525 of the locking arm 520, a locking mechanism spring 1030, a locking arm pivot pin(s) 1040, a locking mechanism rotational stop 1050, a forward retaining pin lock feature 1060, an aft retaining pin lock feature 1070, a slide linkage pivot pin 1090, a locking mechanism shelf stop 1100, and a locking shelf 1110. The pivoting base 525 of the locking arm 520 is pivotally coupled to the safing sector cover 120 via the safing sector slide linkage 1010 and the slide linkage pivot pin 1090, and pivotally coupled to the safing sector slide member 130 via locking arm pivot pin(s) 1040 for moving the safing sector slide member 130 forward and rearward between a closed or fire position, a transition or partial open position, and a safe or fully open position.

As shown in in FIGS. 1A-1D, FIG. 5, FIG. 10, when the safing sector 100 is positioned in the closed or fire position, the safing sector slide control mechanism 140 is in a fully forward and locked position. The locking mechanism spring 1030 applies force to locking mechanism 620 to ensure it is pressed against the locking mechanism rotation stop 1050. The locking mechanism shelf stop 1100 of locking mechanism 620 is engaged with respect to the locking shelf 1110 of the safing sector slide member 130 and this line of force through the locking mechanism pivot pin 1020 locks the locking arm 520 and safing sector slide linkage 1010 in position, preventing locking arm 520 and safing sector slide linkage 1010 from rotating. In the closed or fire position, the locking arm pivot 1000 of the locking arm 520 is over-centered from action line of locking arm pivot pin 1040 and slide linkage pivot pin 1090 that prevents rotation of locking arm 520 and the safing sector slide member 130 remains in a fully forward position. With reference to FIG. 1B, in the fully forward position, as the barrels of the M134 minigun 110 rotate, the forward camming section 900 forces the bolt assemblies forward so that the firing pin of each bolt assembly is placed under heavy spring pressure in preparation for firing a respective cartridge. The aft camming section 910 forces the bolt assembly in the aft direction, guiding the bolt assembly back into the helical tracking within the main housing of the M134 minigun.

Figure 9:
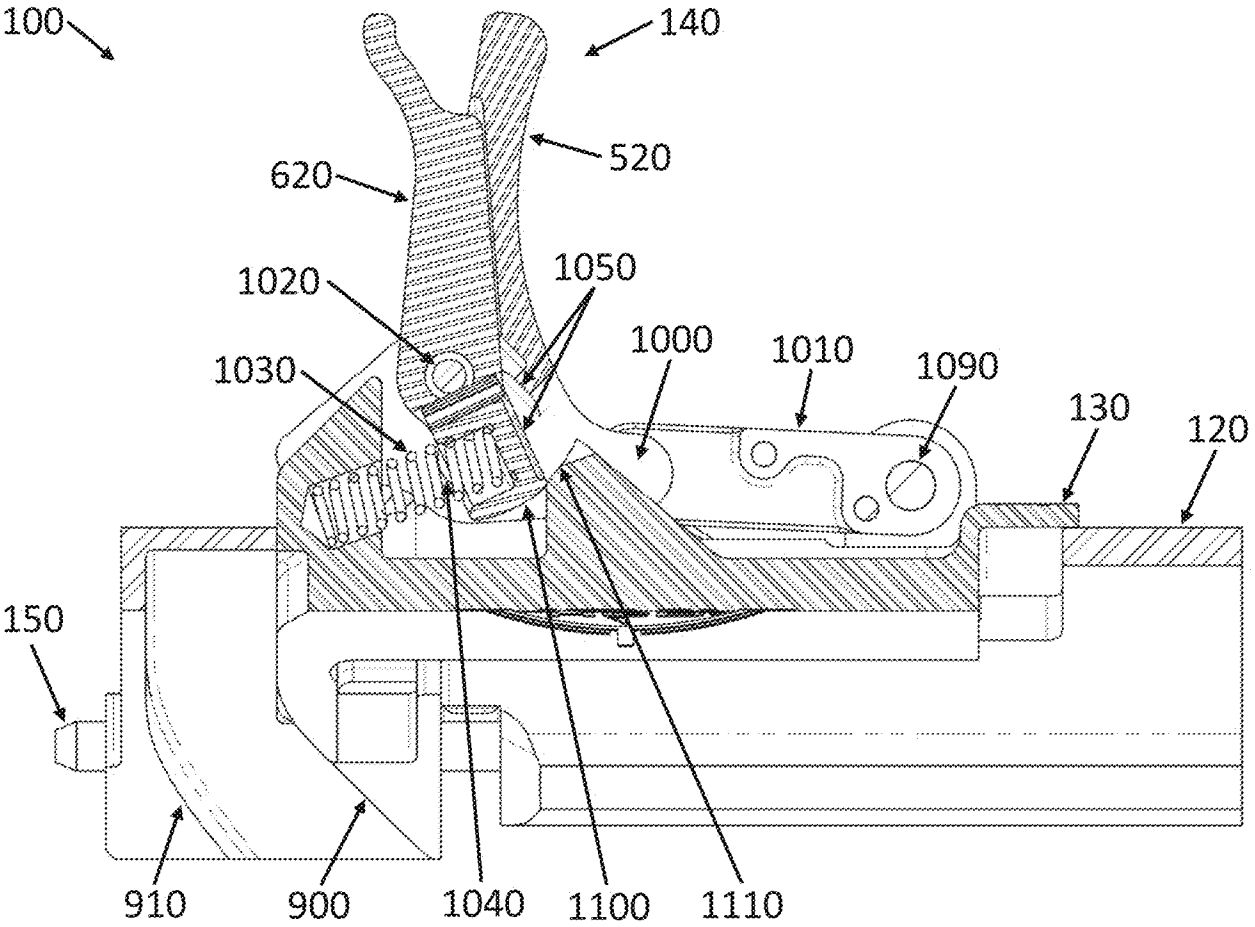
FIG. 9 is a cross-sectional view of the M134 Minigun with the safing sector shown in the transition position.
Figure 10:
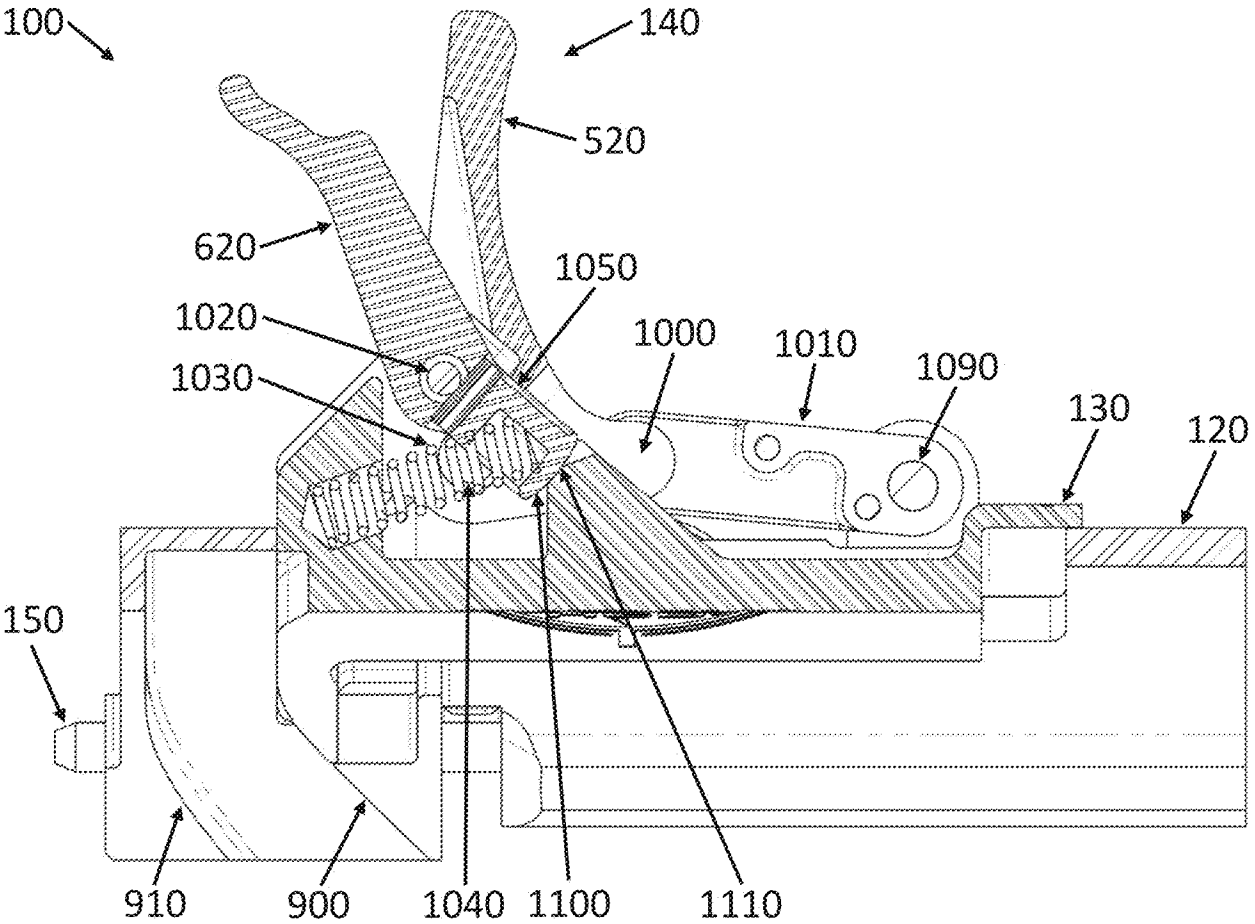
FIG. 10 is a cross-sectional view of the M134 Minigun with the safing sector shown in the closed or fire position.

When the safing sector 100 is positioned in the transition or partial open position shown in FIG. 9, the safing sector slide control mechanism 140, is in a fully forward position. The locking mechanism spring 1030 applies force to locking mechanism 620 that needs to be overcome by operator to ensure locking mechanism 620 has clearance for the locking mechanism rotation stop 1050. The locking mechanism shelf stop 1100 of locking mechanism 620 is no longer engaged with respect to the locking shelf 1110 of the safing sector slide member 130 and allows rotation about locking mechanism pivot pin 1020 to allow rotation of locking arm 520 and safing sector slide linkage 1010. In the transition or partial open position, the locking arm pivot 1000 of the locking arm 520 is no longer over-centered from action line of locking arm pivot pin 1040 and slide linkage pivot pin 1090 that allows rotation of locking arm 520 and the safing sector slide member 130 to move.

When the safing sector 100 is positioned in the installed safe or open position shown in FIGS. 2A-2D, FIG. 6, FIG. 8, the safing sector slide control mechanism 140, is in a fully rearward position. The locking mechanism spring 1030 applies force to locking mechanism 620 that needs to be overcome by operator to ensure locking mechanism 620 has clearance for the locking mechanism rotation stop 1050. The locking mechanism shelf stop 1100 of locking mechanism 620 is no longer engaged with respect to the locking shelf 1110 of the safing sector slide member 130 and allows rotation about locking mechanism pivot pin 1020 to allow rotation of locking arm 520 and safing sector slide linkage

1010. In the safe or open position, the locking arm pivot 1000 of the locking arm 520 is completely out of the action line of locking arm pivot pin 1040 and slide linkage pivot pin 1090 that allows rotation of locking arm 520 and the safing sector slide member 130 to move to fully rearward position. With reference to FIG. 2B, in the rearward position, when the M134 minigun 110 is safed, as the barrels of the M134 minigun 110 rotate, the forward camming section 900 is removed from the overall length of the helical track, while aft camming section 910 is left in place. Consequently, the barrels of the M134 minigun 110 may be rotated electrically without it firing and without the bolt assemblies becoming damaged.

When the safing sector 100 is positioned in the removed safe or open position shown in FIGS. 3A-3D, FIG. 7, FIG. 8, the safing sector slide control mechanism 140 is in a fully rearward position. The locking mechanism spring 1030 applies force to locking mechanism 620 that needs to be overcome by operator to ensure locking mechanism 620 has clearance for the locking mechanism rotation stop 1050. The locking mechanism stop 1100 of locking mechanism 620 is no longer engaged with respect to the locking shelf 1110 of the safing sector slide member 130 and allows rotation about locking mechanism pivot pin 1020 to allow rotation of locking arm 520 and safing sector slide linkage 1010. In the safe or open position, the locking arm pivot 1000 of the locking arm 520 is completely out of the action line of locking arm pivot pin 1040 and slide linkage pivot pin 1090 that allows rotation of locking arm 520 and the safing sector slide member 130 to move to fully rearward position. The retaining pin assemblies 150 are removed from the respective bores in the housing of the M134 minigun 110 by pulling outwardly on the locating knob 720 providing the locating pin 730 over the aft retaining pin lock feature 1070, and releasing the locating knob 720 so that the springs 760 urge the locating knob 720 into the aft retaining pin lock features 1070 as shown in FIGS. 3A-3D and FIG. 7.

The safing sector 100 easily and quickly renders the M134 minigun 110 safe or fire without having to remove components from the assembly. The one inseparable assembly of the safing sector 100 compared to the six removable components of the prior safing sector that could be lost, rendering the minigun non-functional, prevents essential components from being lost. By not removing components and simply sliding the searing surface back, the minigun allows rotation without striking the primer while also preventing a jam in the minigun.

The figures may depict exemplary configurations for the invention, which is done to aid in understanding the features and functionality that can be included in the invention. The invention is not restricted to the illustrated architectures or configurations, but can be implemented using a variety of alternative architectures and configurations. Additionally, although the invention is described above in terms of various exemplary embodiments and implementations, it should be understood that the various features and functionality described in one or more of the individual embodiments with which they are described, but instead can be applied, alone or in some combination, to one or more of the other embodiments of the invention, whether or not such embodiments are described and whether or not such features are presented as being a part of a described embodiment. Thus the breadth and scope of the present invention, especially in the following claims, should not be limited by any of the above-described exemplary embodiments.

Terms and phrases used in this document, and variations thereof, unless otherwise expressly stated, should be construed as open ended as opposed to limiting. As examples of the foregoing: the term "including" should be read as mean "including, without limitation" or the like; the term "example" is used to provide exemplary instances of the item in discussion, not an exhaustive or limiting list thereof; and adjectives such as "conventional," "traditional," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although item, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

We claim:

1. A safing sector for a minigun including a housing with an opening adjacent to barrels of the minigun, comprising:

a safing sector cover configured to cover the opening of the housing of the minigun;

one or more retaining pin assemblies configured to retain the cover to the housing of the minigun;

a safing sector slide member configured to slide forward and rearward relative to the safing sector cover and including a concave locking shelf;

a safing sector slide control mechanism configured to impart the forward and rearward sliding movement of the safing sector slide member relative to the safing sector cover between at least a fire position and a safe position, where the barrels of the minigun may be rotated electrically without firing and without bolt assemblies becoming damaged, the safing sector slide control mechanism includes a locking arm configured to impart forward and rearward sliding movement of the safing sector slide member relative to the safing sector cover, and a locking mechanism pivotally coupled to the locking arm and including a distal end terminating in a convex locking mechanism shelf stop to push on and engage the concave locking shelf of the safing sector slide member to lock the locking arm and the safing sector slide member in the fire position.

2. The safing sector of claim 1, wherein the locking arm includes a pivoting base, and the locking mechanism includes a base pivotally coupled to the pivoting base of the locking arm between a locking position where the locking mechanism shelf stop engages the locking shelf of the safing sector slide member to lock the locking arm and the safing sector slide member in the fire position and an unlocked position where locking arm is free to pivot to impart forward and rearward sliding movement of the safing sector slide member relative to the safing sector cover.

3. The safing sector of claim 1, wherein the locking arm is configured to impart rearward and forward sliding movement of the safing sector slide member relative to the safing sector cover between at least three positions, a fire position, a safe position, and an install position.

4. The safing sector of claim 1, wherein the locking mechanism includes a spring to urge the locking mechanism shelf stop towards the locking shelf of the safing sector slide member.

5. The safing sector of claim 1, wherein the one or more retaining pin assemblies include a locating knob actuatable to latch and unlatch the one or more retaining pin assemblies relative to the safing sector cover.

6. A method of using the safing sector of claim 1, comprising:

imparting forward and rearward sliding movement of the safing sector slide member relative to the safing sector cover by moving the locking arm;

locking the locking arm and the safing sector slide member in the fire position by engaging the locking mechanism shelf stop with the locking shelf of the safing sector slide member.

7. The method of claim 6, wherein the locking arm includes a pivoting base, and the locking mechanism includes a base pivotally coupled to the pivoting base of the locking arm between a locking position where the locking mechanism shelf stop engages the locking shelf of the safing sector slide member to lock the locking arm and the safing sector slide member in the fire position and an unlocked position where locking arm is free to pivot to impart forward and rearward sliding movement of the safing sector slide member relative to the safing sector cover, and locking the locking arm and the safing sector slide member in the fire position by pivoting the base of the locking mechanism relative to the pivoting base of the locking arm to the locking position where the locking mechanism shelf stop engages the locking shelf of the safing sector slide member.

8. The method of claim 6, wherein the locking arm is configured to impart rearward and forward sliding movement of the safing sector slide member relative to the safing sector cover between at least three positions: a fire position, a safe position, and an install position, and method further comprising imparting rearward and forward sliding movement of the safing sector slide member relative to the safing sector cover between at least three positions, a fire position, a safe position, and an install position, by moving the locking arm.

9. The method of claim 6, wherein the locking mechanism includes a spring to urge the locking mechanism shelf stop towards the locking shelf of the safing sector slide member, and locking includes urging the locking mechanism shelf stop towards the locking shelf of the safing sector slide member with the spring.

10. The method of claim 6, wherein the one or more retaining pin assemblies include a locating knob actuatable to latch and unlatch the one or more retaining pin assemblies relative to the safing sector cover, and the method further comprising actuating the locating knob actuatable to latch and unlatch the one or more retaining pin assemblies relative to the safing sector cover.

* * * * *